US005132661A

United States Patent [19]

Pinnow

[11] Patent Number: 5,132,661

[45] Date of Patent: * Jul. 21, 1992

[54] SECURITY SYSTEM EMPLOYING OPTICAL KEY SHAPE READER

[75] Inventor: Douglas A. Pinnow, Laguna Hills, Calif.

[73] Assignee: Universal Photonix, Inc., Laguna Hills, Calif.

[ * ] Notice: The portion of the term of this patent subsequent to Sep. 19, 2006 has been disclaimed.

[21] Appl. No.: 490,627

[22] PCT Filed: Sep. 30, 1988

[86] PCT No.: PCT/US88/03345

§ 371 Date: Mar. 19, 1990

§ 102(e) Date: Mar. 19, 1990

[87] PCT Pub. No.: WO89/02969

PCT Pub. Date: Apr. 6, 1989

Related U.S. Application Data

[63] Continuation-in-part of Ser. No. 103,646, Oct. 2, 1987, Pat. No. 4,868,559.

[51] Int. Cl.[5] ..... E05B 47/00

[52] U.S. Cl. ..... 340/825.31; 70/277; 70/DIG. 51; 361/172

[58] Field of Search ..... 340/825.31, 825.34; 70/277, 278; 361/172, 173; 235/382

[56] References Cited

U.S. PATENT DOCUMENTS

| | | | |
|---|---|---|---|
| 3,733,862 | 5/1973 | Killmeyer | 70/277 |
| 3,797,939 | 3/1974 | Pryor | 356/111 |
| 3,840,857 | 10/1974 | Knight et al. | 340/146.3 |
| 3,843,261 | 10/1974 | Pryor | 356/111 |
| 3,889,501 | 6/1975 | Fort | 361/172 |
| 4,050,063 | 9/1977 | Schull | 340/274 |
| 4,142,387 | 3/1979 | Bergkvist | 70/278 |
| 4,144,523 | 5/1979 | Kaplit | 340/825.31 |
| 4,148,372 | 4/1979 | Schroeder | 180/114 |
| 4,237,375 | 12/1980 | Granholm | 235/487 |
| 4,280,119 | 7/1981 | May | 340/147 |
| 4,288,780 | 9/1981 | Theodoru | 340/146.3 |
| 4,298,792 | 11/1981 | Granholm | 235/474 |
| 4,322,719 | 3/1982 | Moorhouse | 235/383 |
| 4,326,124 | 4/1982 | Faude | 235/382 |
| 4,404,684 | 9/1983 | Takada | 382/25 |
| 4,415,893 | 11/1983 | Roland et al. | 340/825.31 |
| 4,594,505 | 6/1986 | Sugimoto | 70/DIG. 51 |
| 4,868,559 | 9/1989 | Pinnow | 340/825.31 |

FOREIGN PATENT DOCUMENTS

| | | |
|---|---|---|
| 2141775 | 1/1985 | United Kingdom . |
| WO87/00233 | 1/1987 | World Int. Prop. O. . |

*Primary Examiner*—Donald J. Yusko
*Assistant Examiner*—John Giust
*Attorney, Agent, or Firm*—Bacon & Thomas

[57] ABSTRACT

A security system which employs an optical key shape reader to photoelectrically derive an electrical signal from a shape characteristic of a key is disclosed. The system provides heightened security over standard key operated systems and is particularly well suited for use in motor vehicles.

33 Claims, 8 Drawing Sheets

SECURITY SYSTEM EMPLOYING OPTICAL KEY SHAPE READER

CROSS REFERENCE TO RELATED APPLICATIONS

This application is a continuation-in-part of application Ser. No. 103,646 filed Oct. 2, 1987, now U.S. Pat. No. 4,868,559, and related to PCT/US88/03345.

BACKGROUND OF THE INVENTION

1. Technical Field of the Invention

The subject invention is a security system which employs an optical key shape reader. The system is particularly suited for use in automobiles and other motor vehicles.

2. Description of the Prior Art

Automobile theft has become an increasingly prevalent problem for our society. In particular, expensive sports and luxury cars have become targets for thieves. Simple key locks for such vehicles are no match for experienced thieves who are able to enter and start the vehicles in a matter of seconds.

In an effort to increase the security of automobiles, efforts have been made to develop new, high security systems. One such system was introduced by General Motors Corporation in 1986 for its Corvette model line. The system is called a Vehicle Anti Theft System or VATS. This system is described in detail in a paper entitled "The Vehicle Anti-Theft System--VATS" by Schroeder et al., SAE Technical Paper Series, 1986.

As described therein, VATS uses a modified ignition key with an electrical resistor pellet embedded in the upper shaft of a standard key. The electrical resistor has one of fifteen possible resistance values. In order to start the car, the VATS ignition key must have the proper cuts, like any conventional key, as well as the correct resistance value. The resistance of the pellet is sensed by electrical contacts built into the ignition lock. These contacts are connected by wires to a remote VATS module where the decision is made if the correct resistor pellet is in the key. The significant feature about VATS is that the decision to accept or reject the key is made remote from the ignition lock and steering column. This defeats the most common mode of automotive theft which is to use a hammer to crack open the plastic housing that surrounds the steering column and ignition lock, followed by the use of a screw driver to force the ignition mechanical linkages to start the ignition. The VATS module is located behind the instrument panel, heating ducts and electrical wiring so that a thief would have to spend a considerable time to reach the module to disconnect it or modify it.

While at first blush it may appear that the fifteen resistor values are too few in number to achieve appreciable additional security, if the wrong resistor is selected, a time delay of from two to four minutes is imposed before the system will accept another resistance value. On the average, it will take seven or eight attempts before the correct resistor is randomly selected. This will cause the thief to be at risk of being caught for as long as a half an hour, long enough to deter many, but not all, thieves.

While VATS has provided increased security for vehicles in which it is installed, it has experienced numerous problems which prevent a legitimate owner from starting his automobile. These problems include: the resistor pellets falling out of the keys; bent electrical contacts in the lock often caused by the operator rotating the key before it is fully inserted in the lock; added series resistance due to corrosion of the electrical contacts resulting in invalid readings; fraying of the wires of the lock contacts which rotate every time the car is turned on or off and the expense and inconvenience of obtaining replacement or duplicate keys from locksmiths.

It has also been proposed to use a digital key in a security system in which the key is provided with a digital code which is optically read and compared to a code stored in a memory unit of the lock when the codes match. U.S. Pat. No 4,144,523 to Kaplit describes such a digital key system which includes circuitry responsive to a digital pulse train generated upon removal of the key from the lock for programming the digital key code into the lock memory as well as circuitry for reading the digital key code when a key is inserted in the lock, for comparing it to the code stored in the memory and for disabling the lock when the codes match. The digital code is placed on each key by the absence or presence of a hole in a first row of holes on the key. A similarly digitally encoded key system is described in International Patent Application PCT/GB86/00394 to O'Connell et al.

In both systems described by Kaplit and O'Connell et al., a second row of holes must be provided in the key to serve as a clock-track to control when a reading is made of the row of code holes to obtain the digital data. While O'Connell et al. use the word "may" implying that a clock-track is optional, there is no other way disclosed by them to insure accurate reading of the code row. A separate combination of a light emitting diode and photodetector are required to generate and receive optical signals for each row of holes on the key. The requirement for two rows of holes on the key to provide the code and clock-tracks necessitates that the holes be relatively small, thus increasing the tendency for the holes to be blocked by dirt or other foreign matter. In addition, in both systems described by Kaplit and O'Connell, the photoelectrical elements are disposed on the rotating lock core which presents the problem of failure due to wire fatigue when the lock is rotated over time, just as in the VATS system.

Accordingly, there remains a need in the art for a security system having particular application to motor vehicles, which provides heightened security without being subject to the problems which characterize existing security systems.

SUMMARY OF THE INVENTION

The present invention overcomes the shortcomings of existing security systems, including VATS, by utilizing a shape characteristic of a key such as one or more cuts in a standard key to photoelectrically derive an electrical signal that can be processed at a remote location. In automobiles, this location is remote from the ignition lock and steering column, typically behind the dashboard. The electrical signal can also be photoelectrically derived from a pattern of slots or holes which is introduced into the upper or lower shaft of a conventional key. A separate pattern of slots or holes to provide a clock-track is not required.

The security system of the invention comprises means for photoelectrically deriving an electrical signal from the shape of a key, means which may be remote from said photoelectrical means for comparing said electrical signal to one or more electrical signals stored in memory to determine whether they are the same and means for enabling a function upon determination that the photoelectrically derived electrical signal is the same as an electrical signal stored in memory. In motor vehicles the function that is enabled upon receipt of the proper signal is the starter and/or fuel injector of the vehicle. Other appropriate functions include the deactivation of an electronic lock or other security device.

Other preferred embodiments of the invention are disclosed in the detailed description which follows.

BRIEF DESCRIPTION OF THE FIGURES OF DRAWING

DETAILED DESCRIPTION OF THE PREFERRED EMBODIMENTS

Figure 1:
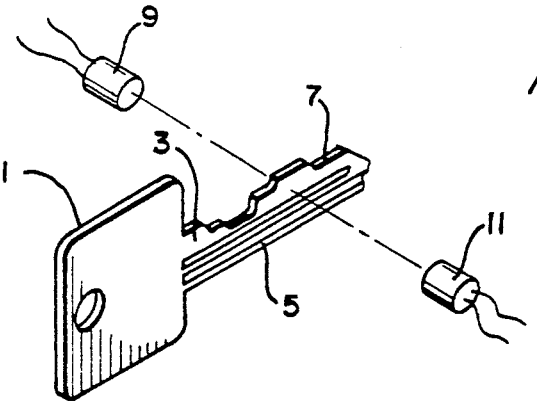
FIG. 1 is a representation of the manner in which an electrical signal is photoelectrically derived from the shape of a key.
Figure 2:
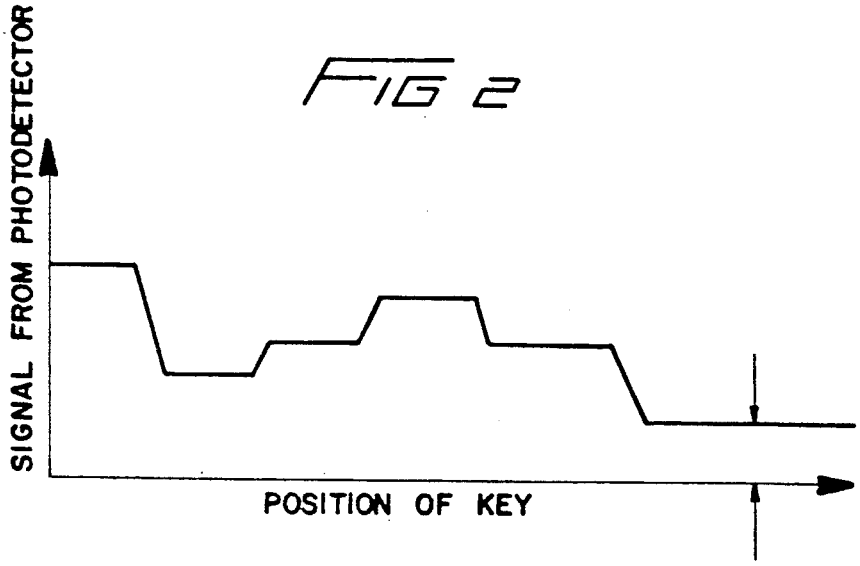
FIG. 2 is a graph showing the relationship between the signal generated by the intensity of light received by a photodetector and the position of a key in the system of the invention.

FIG. 1 illustrates one way in which an electrical signal can be photoelectrically derived from the shape of a standard key. Key 1 is comprised of an upper shaft portion 3 and a lower shaft portion 5. The lower shaft portion contains a plurality of cuts 7 along one of its edges which uniquely define the key code or shape. Light emitting diode 9 and photodiode 11 are positioned opposite one another, perpendicular to the path traversed by the key when it is inserted in a lock. As the key is inserted, the lower shaft portion blocks a portion of the light being transmitted by the light emitting diode to the photodiode. The intensity of light received by the photodiode is directly related to the depth of the cuts along the edge of the lower shaft portion of the key. Hence, as depicted in FIG. 2, a plot of the intensity of the signal from the photodiode reproduces the shape of the key. The signal from the photodiode is transmitted through wires to a remote location where it is analyzed to determine whether it corresponds to a valid key shape. This analysis is performed by a processor which compares the signal from the photodiode to one or more valid signals stored in its memory. If the signals match, the processor issues an enable signal to enable the appropriate function, i.e., enabling the starter or fuel injector of a motor vehicle.

To insure that the optical key shape reader is tolerant to partial obscuration or change in brightness of the light emitting diode, the system preferably includes a self-calibration method. Each time a key shape is read a new optical reference level is established before the key is inserted and immediately after the key is fully inserted into the lock. For example, the difference between these two signal levels is simply divided into five equal parts corresponding to the different cut depths in a standard metal key such as the five depths used by General Motors.

Figure 3A:
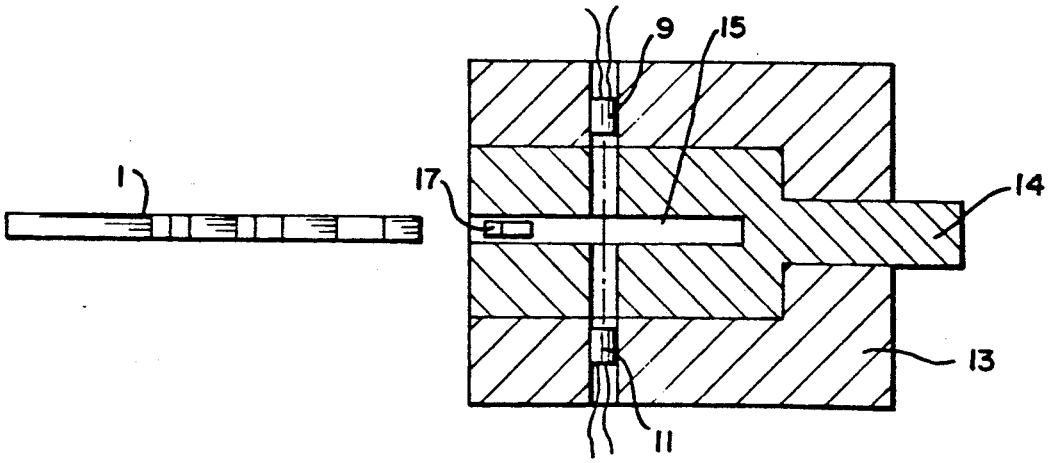
FIG. 3A is a cross sectional view of an ignition lock for a motor vehicle containing an optical key shape reader in accordance with the invention.

FIG. 3A shows a design for a key shape reader in which the light emitting diode 9 and the photodetector 11 are incorporated into the shell of an ignition lock 13. It is beneficial to locate these electro-optic components in the shell which remains in a fixed position when the core of the lock 14 is rotated. This eliminates fatigue failure of the electrical wires needed to operate the device. When key 1 is inserted into the key chamber 15 it trips switch 17 and turns on the key shape reader which generates a photoelectrical signal corresponding to the shape of the key. Switch is not required when power is continuously supplied to the system so that the key shape reader is always in an active condition or when the system is enabled by a command signal from another source, as discussed in detail below.

Figure 3B:
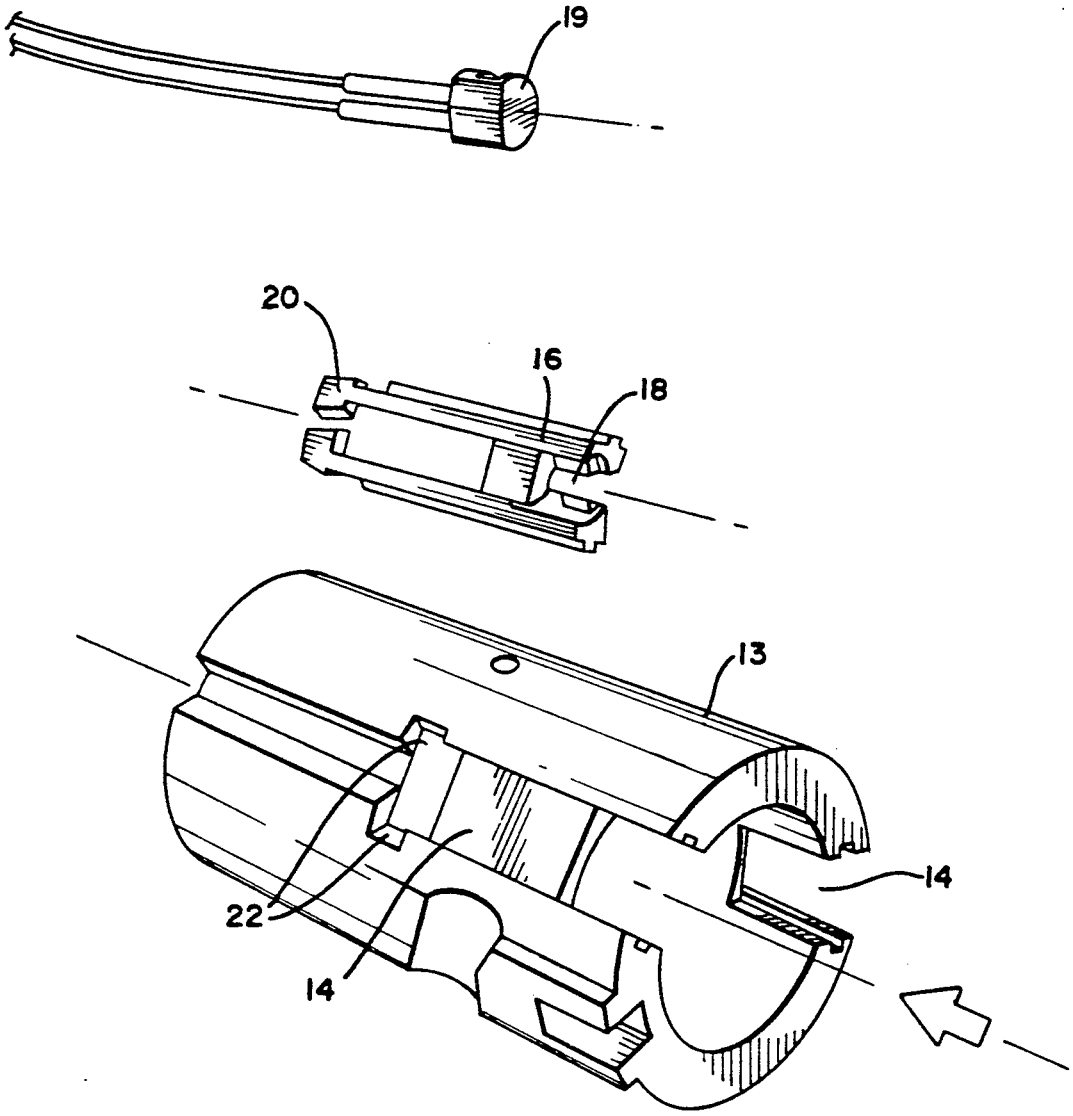
FIG. 3B is an exploded view of an ignition lock shell with carrier means for the photoelectrical components.

FIG. 3B illustrates a preferred manner of mounting the light emitting diode and photodetector on the shell of the ignition lock. Shell 13 is modified to include two axially extending slots 14 for slidably receiving electro-optic carriers 16. The light emitting diode 9 and photodetector (now shown) are snapped into opening 18 on their respective carrier and the carrier is slid onto the shell in the direction of the arrow. Each carrier 16 contains a split rear section 20 which snaps into rear end slots 22 on the shell to secure the carrier in place. When slid and snapped in position, each carrier's optic component faces the other across the keyway for establishing the optical signal path.

Figure 4:
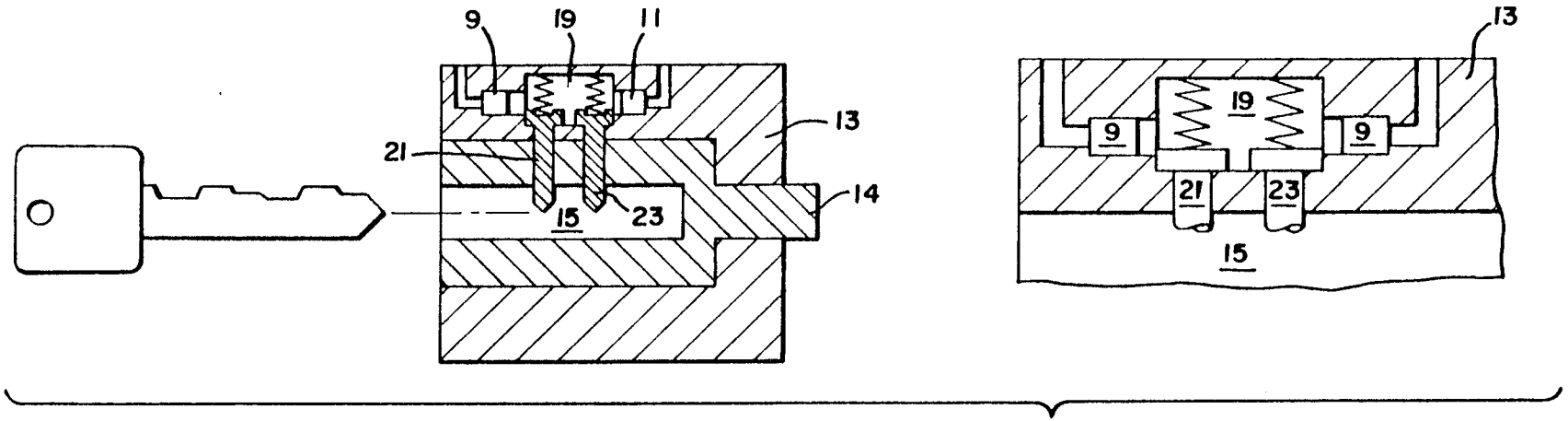
FIG. 4 is a cross sectional view of an alternative design for an ignition lock with an optical key shape reader in accordance with the invention.

FIG. 4 shows an alternative lock design which includes a separate clean chamber 19 above the key chamber 15 for housing the optical shape reader. In this embodiment, the shape reader is activated when the key is inserted into the key chamber causing a first pin 21 to trip a microswitch (not shown). As the key moves further into the key chamber it pushes against a second pin 23. As pin 23 is displaced upwards in the clean chamber by the pattern of cuts in the lower shaft portion of the key, it obscures the path of light being transmitted by the light emitting diode 9 to the photodetector 11. This results in a photoelectrical signal from the photodiode which corresponds to the shape of the key. Obviously, in order to prevent first pin 21 from affecting the intensity of light received by the photodetector 11, it must be positioned in chamber 19 so as to be at all times outside the optical path between light emitting diode 9 and photodetector 11.

Figure 5A:
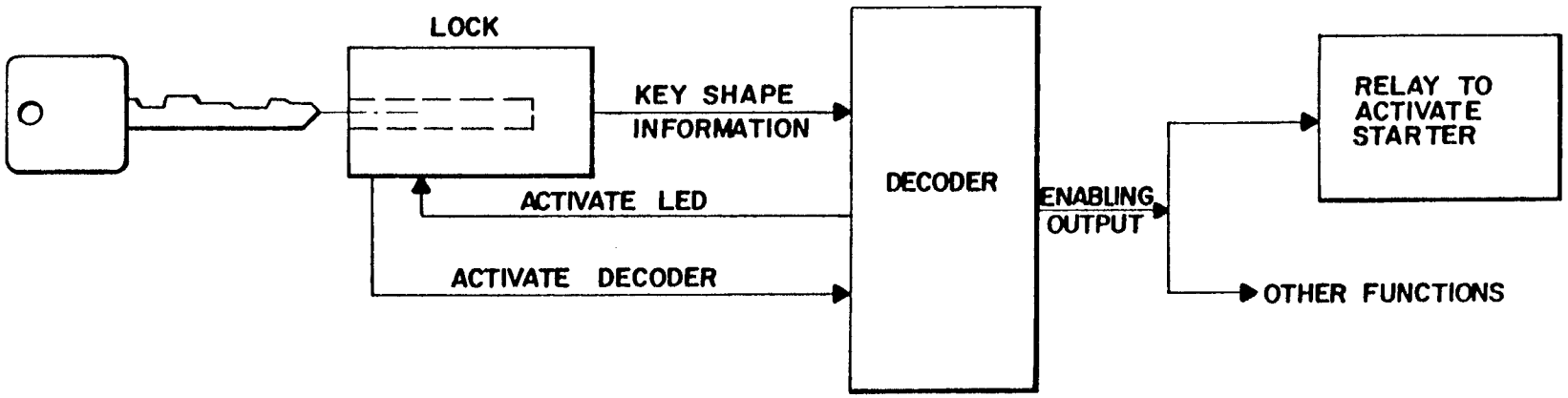
FIG. 5A is a schematic representation of the security system of the invention applied to a motor vehicle.

FIG. 5A shows schematically the relationship between the optical key shape reader and the remote processing means, referred to generally as the decoder, for analyzing the signal from the photodetector in the key shape reader and comparing it to one or more signals stored in a memory unit of the processing means to determine if the signal corresponds to a valid key. If so, the processing means issues enable signals for particular functions. In the case of an automobile, the enable signal energizes a relay switch which activates a component required to start the automobile, e.g., the starter solenoid and/or the fuel injector system. In some cases an electronically activated shut off valve in the fuel line may also be energized. Other functions may also be enabled as discussed more fully below.

Figure 5B:
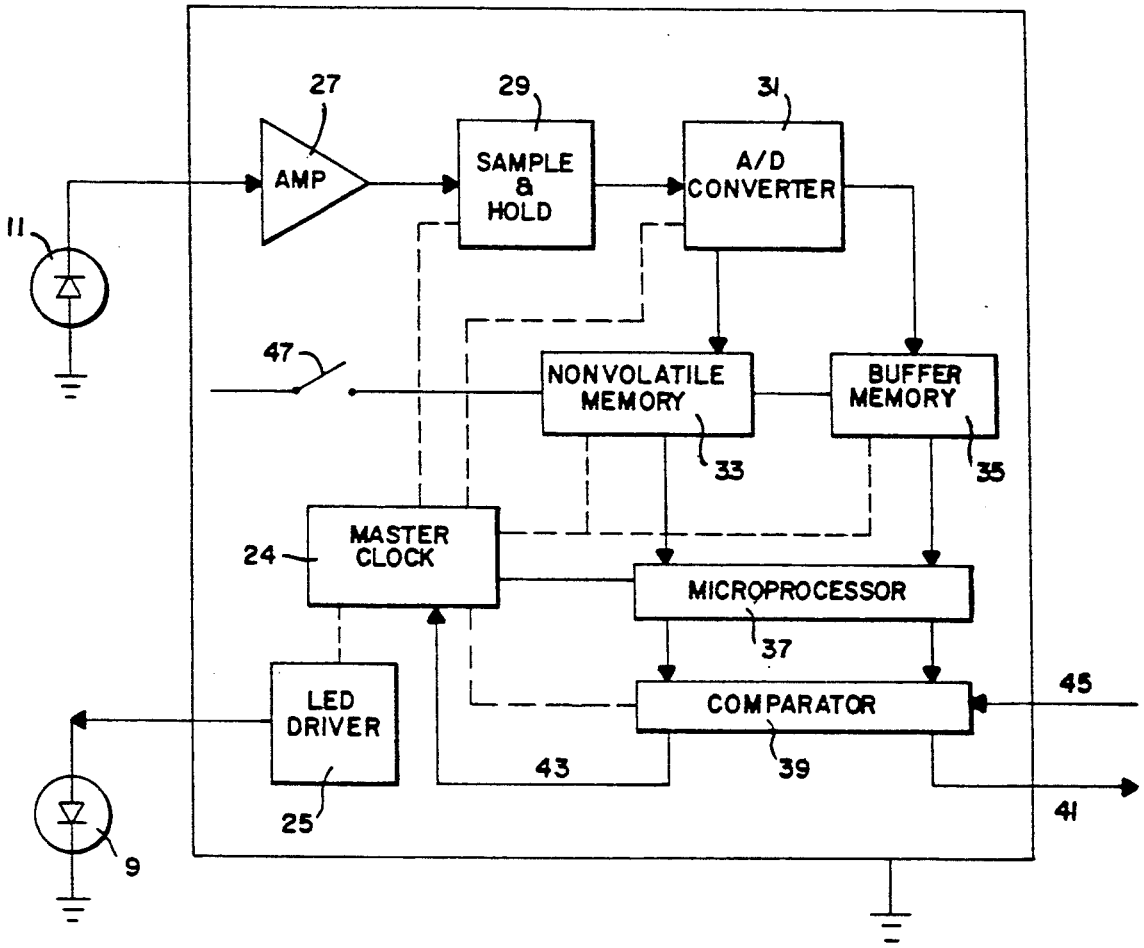
FIG. 5B is a schematic representation of the decoder portion of the system shown in FIG. 5A.

FIG. 5B is a detailed drawing showing the components contained in the decoder. The decoder is a processor for verifying key shape information and for introducing an enabling signal if verification occurs. A master clock 24 is used to provide the AC modulated signal to LED driver 25, as well as all the electronic timing functions for the memories, processor, etc. The intensity of the signal received by the photodiode 11 is modulated in time as the key is inserted into the lock. This modulated signal is amplified by amplifier 27 and then periodically sampled by the sample and hold unit 29. Sampling occurs at a rate which is sufficient to obtain several samples of each key shape characteristic regardless of the key insertion rate. Conventional keys have bit cuts which form a series of plateaus of various heights that align with the corresponding tumblers when the key is fully inserted into the lock. Between these plateaus are tapered sections. Thus, as a key is inserted into the keyway the plateaus and tapers on the key pass through the optical beam formed between the light emitting diode and photodetector. As the first plateau passes through the beam, a series of samples, all of similar amplitude, are detected. Due to the variable insertion rate from one key insertion to the next, the specific number of samples identifying a plateau is not important. The only significant factor is that the plateau is defined by some minimum number of samples of similar amplitude before the amplitude begins to vary as the tapered section to the next plateau passes through he optical beam. In a similar fashion, the second and subsequent plateaus are identified and their heights noted.

After sampling, the analog signal is digitized by the A/D converter 31 and directed to a memory. The very first signal received when a key is initially inserted is sent to a nonvolatile memory 33 where it serves as a permanent reference signal for the correct key. Storing the reference signal in a nonvolatile memory insures that it will not be lost, even if power to the system is disconnected. Storing the reference signal in this manner also allows assembly plants to install the system without pre-matching a key and a decoder. For all subsequent operations, the signal is sent to a buffer memory 35. The outputs from the nonvolatile memory and buffer memory are both processed to extract the essential key shape information in the processor 37 and then compared in the comparator 39. A match results in an enabling output 41 while a mismatch results in a time delay 43. As in the VATS system previously described, the time delay prevents a thief from rapidly cycling through all possible code combinations until the valid code is randomly selected. An optional, yet desirable, feature is to delay the enabling output from the comparator until it receives a signal 45 that the ignition lock was rotated to the "start" position. This avoids starting a time delay sequence until the mechanical portion of the key code is validated by the mechanical position of the lock. A reset switch 47 is added to clear the nonvolatile memory in the event that the ignition lock is replaced and a new key code is used. The reset switch is positioned so that it is not readily accessible to prevent unauthorized use.

In operation of the decoder shown in FIG. 5B, the master clock typically operates at 30 to 40 KHz to modulate the LED. Sampling of the received signal is performed 500 times per second for a period of up to 5 seconds and digitalization requires 4 bits per sample. These parameters determine the size of the memories each at approximately 10,000 bits which is well within the state of the art.

Figure 5C:
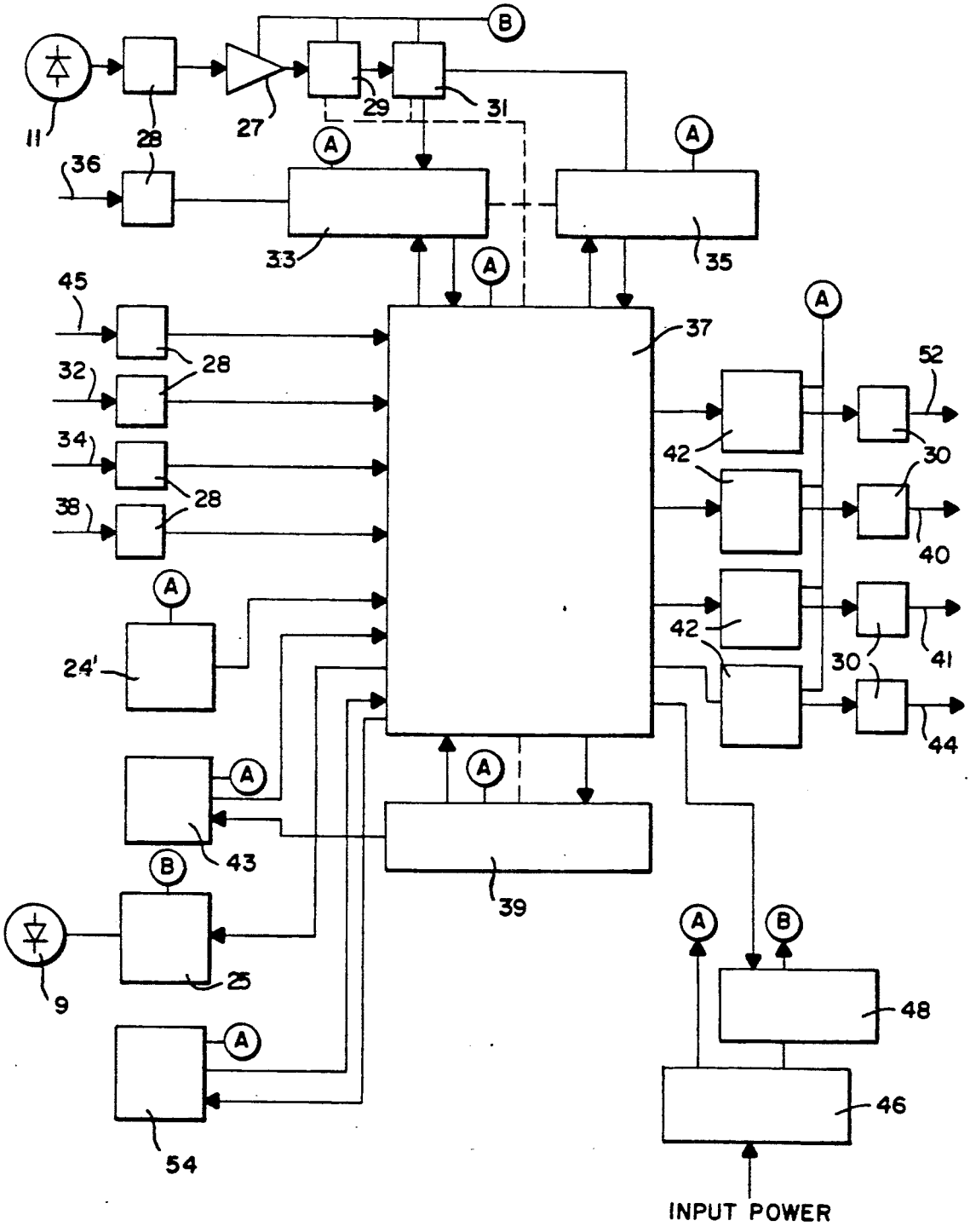
FIG. 5C is a schematic representation of an alternative decoder design for use in the system shown in FIG. 5A.

In a preferred embodiment, shown in FIG. 5C, master clock 24 is a two speed oscillator which conserves power used by the system so that it can remain continuously active and provide higher sampling rates for more accurate key reading. The two speed master clock 24' provides two sampling rates for controlling sample and hold 29, A/D converter 31 and comparator 39 through microprocessor 37 as shown by the dashed lines in the figure. When the system is in the standby condition, the master clock 24' runs at a slow speed consuming very low amounts of electrical current from the automobile battery or other power source. This insures that the power source will not be discharged even if the system remains in the standby condition for an extended period of time. This is a particularly important requirement for automobiles to prevent battery drain if the automobile is parked for several weeks at a time. In the standby condition, sampling of the optical signal occurs at a rate as low as 50 to 100 samples per second, but more typically at a rate of about 200 samples per second.

When a key is inserted into the keyway, its presence is detected by the reduced optical signal level of the sampled signal. The microprocessor 37 senses the reduced optical signal level and switches master clock 24' to its second, higher speed causing sampling of the optical signal at a greater increased rate between about 1,500 and 2,000 samples per second, most typically about 1,800 samples per second to acquire data regarding the key shape. A separate switch (17 in FIG. 3) is not required to activate the system since it is continually on, albeit in a standby condition. It is also possible to activate the system to standby status by a command signal from the microprocessor, for example, when it senses that a door has been legitimately opened, to provide further power conservation.

At the lower standby sampling rate, it would be possible for a shape characteristic of a key to pass completely by the photodetector between samples. At the higher sample rate, however, there will be at least 10 samples per key shape characteristic even at the fastest rates of insertion of the key into the keyway. With this many samples, signal averaging can be used to characterize the entire shape profile of the key as it passes by the photodetector and the peak value stored in the memory for later comparison with the valid code. Specific examples of the sampling technique are provided later in this disclosure in discussing FIGS. 8A–8C.

FIG. 5C also illustrates how additional inputs, other than from ignition 45 and additional outputs, other than start enable 41, can be controlled by the system. As shown in this figure, there are five inputs and four outputs. Each input and output are protected by input protection and output protection components 28 and 30, which prevent damage to the internal components of the system in the event these terminals are tied to a voltage source or grounded. Such components are well known to the automotive industry. Output drivers 42 are turned on and off by microprocessor 37 and supply the power to drive the various outputs as is also well known to the art.

As previously explained with regard to FIG. 5B, ignition enable 45 initiates the code comparison when the ignition lock is rotated to the run position. Input 32 can be connected to another security system to disable the optical key shape system until the security system has been properly disarmed. Speed up input 34 is used to speed up the time delay to permit testing of the system. It can only be enabled along with another key which prevents unauthorized enabling by a thief. Reset input 36 is connected to reset switch 47 (see FIG. 5B) to clear the nonvolatile memory 33 in order to reprogram the system with a new code. This input also requires a separate key to prevent unauthorized access. Door monitor 38 monitors the position of the driver's door pin switch for signalling to sound a chime if the key is left in the ignition when the door is open. This input eliminates the need for the conventional key-in-the-ignition switch.

Start enable output 41 has been previously discussed as providing the enabling signal to the engine starter for an automobile or other enabling function for a different system. Fuel enable output 40 provides a like enabling 5 signal to enable an automobile's fuel system. Chime output 52 sounds a chime repeatedly to indicate that a key has been left in the ignition when the driver's door is open. Diagnostic lamp output 44 indicates the state of the system such as lamp test, key reinsertion, or time delay.

The decoder also preferably includes a watchdog monitor 54 which runs independently of the microprocessor to reset the microprocessor should its operation be interrupted for any reason. Thus, if the microprocessor locks-up or otherwise malfunctions, as can occur if it is rapidly turned on and off, the watchdog monitor insures that it will be reset for continuation of normal operation.

Power conditioner 46 filters the power input line to the system to remove noise and voltage spikes and provide regulated voltage to the components in the system. Power controller 48 switches power to the various components marked B so that they are only on when needed and off the rest of the time to conserve power. Components marked A receive the unswitched power from the power conditioner.

The microprocessor 37, which is the heart of the decoder, is a commercially available part which is programmed to operate the system as described above. It is also preferred to program into the microprocessor an automatic level control feature that stabilizes the optical signal intensity of the light emitting diode within the ignition lock's keyway. This feature is useful to ensure that there is a sufficient optical signal level to detect shape characteristics of a key even over broad temperature ranges, e.g. −40° C. to +75° C. Without such stabilization, normal temperature drifts of the light emitting diode output and other electronic components would result in unsatisfactory operation of the system at high and low temperatures. In order to provide the automatic level control, the microprocessor is programmed to put out a drive signal to the light emitting diode in the ignition lock sufficient to maintain a constant optical detector level. The output is constantly monitored by the photodetector in the standby condition. Any small and slow variation in the received signal is interpreted as temperature drift and is corrected by the microprocessor's instructions to the LED driver. An abrupt variation in received level is interpreted as the beginning of the key insertion which triggers the operation of the system as previously described.

Figure 6A:
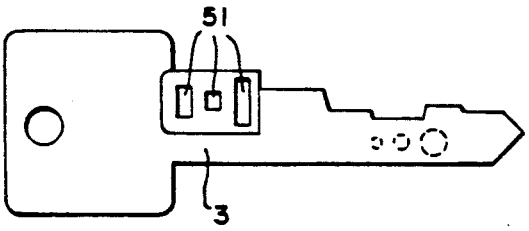
FIG. 6A is a representation of an alternative design for a key for use with the security system of the invention.
Figure 6B:
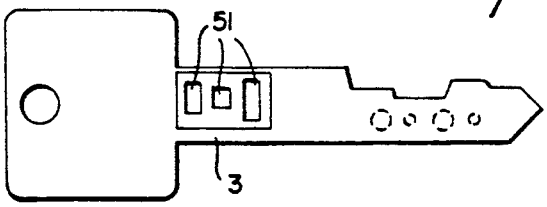
FIG. 6B is a representation of another alternative design for a key for use with the security system of the invention.

FIGS. 6A and 6B show alternative key designs for use with the security system of the invention. Instead of using the cuts in a conventional key, it uses a series of three slots 51 in the upper shaft portion 3 of the key. The heights of the three slots are optically read in sequence as the key is inserted into the lock. In FIG. 6A, the slots are positioned on a plate which extends beyond the edge of upper shaft portion 3 of the key. In FIG. 6B, the slots are shown to be on a plate which is inserted into the upper shaft portion 3 of the key with no extending part.

One of the slots which is optically read should desirably be full height, representing the 100% calibration level. In FIGS. 6A and 6B, the first slot is full height. The second slot has four levels corresponding to twenty, forty, sixty and eighty percent of full height. The third slot has five levels, corresponding to twenty through one hundred percent, in equal increments. The total number of combinations is, therefore, $4\times5=20$. However, in cases where the slots are not separated by an area of solid material, it is desirable to exclude combinations where the second and third slots are cut to the same level because the electronics may become confused. This eliminates four combinations, leaving a balance of sixteen possibilities. This is similar to the fifteen different resistance values offered by VATS. Because of the small dimensions of these slots it is useful to have them formed in a thin metal plate 8 which is fixed to the key by deforming the metal of the key over tabs on the plate. Dirt accumulation in the plate slots will be minimized if the ratio of slot width to plate thickness is greater than unity.

Figure 8A:
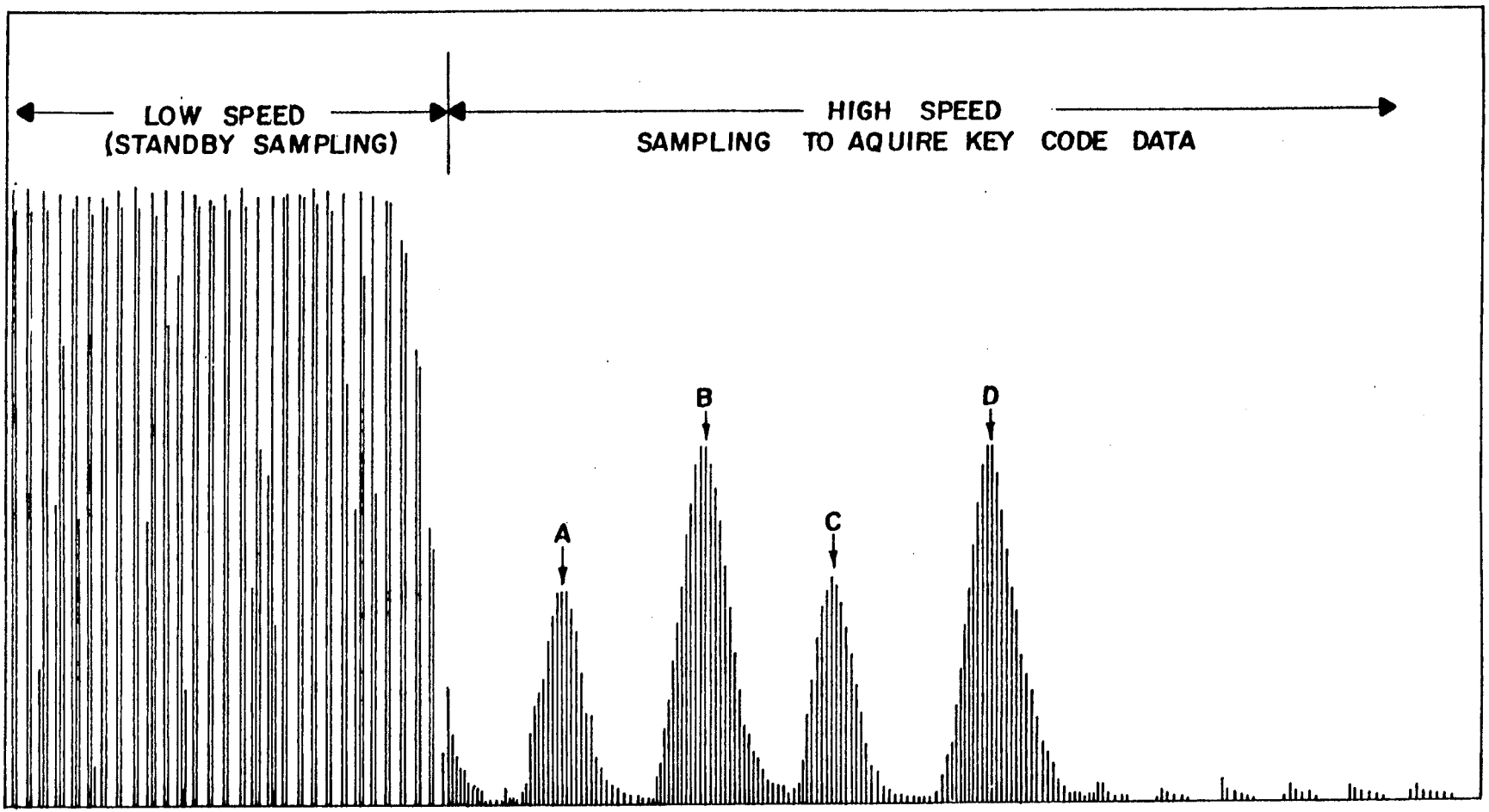
FIGS. 8A–8C are graphical depictions of sampling used to obtain data for a key shape in the system of the invention.
Figure 8C:
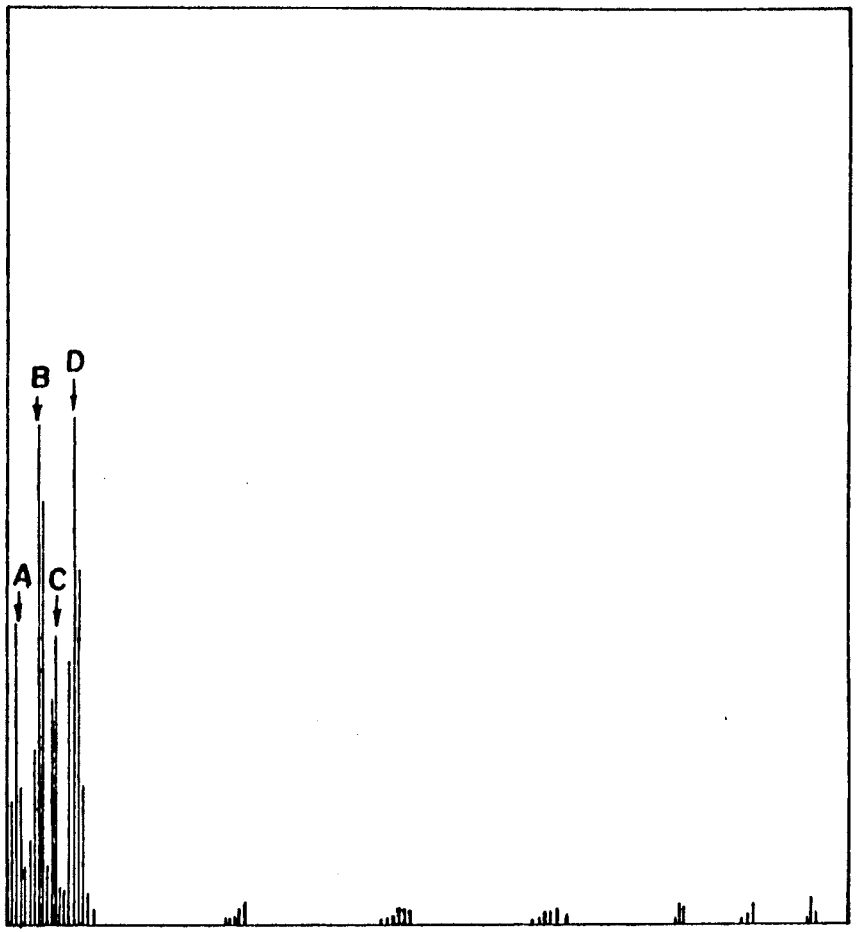
Figure 8B:
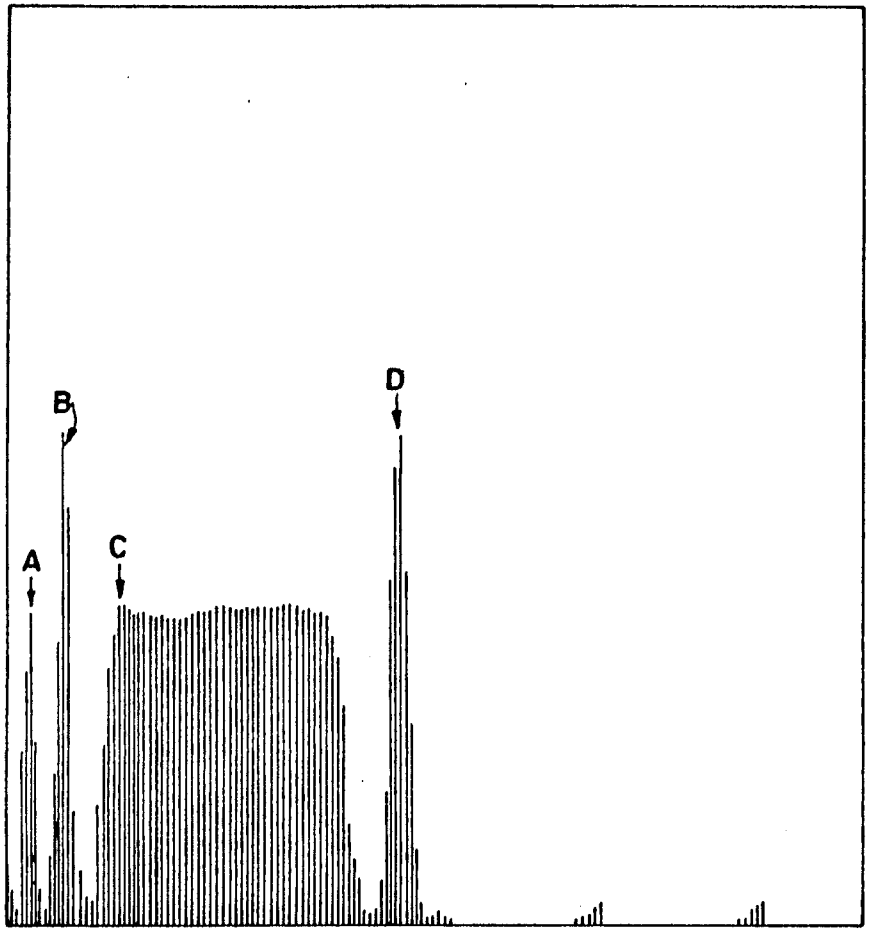

Alternatively, holes of varying diameter (shown in phantom on FIGS. 6A and 6B) may be used in place of slots. In FIG. 6A, three holes having three different diameters are shown, while in FIG. 6B four holes having one of two diameters are shown. The holes can be located on the lower shaft portion of the key. Typical data showing the amplitude of the sampled signal versus time is shown in FIGS. 8A–8C for a key in which information is encoded in a digital formal using a series of four holes having one of two diameters, i.e., large or small, in the shank of the key as depicted in FIG. 6B. FIG. 8A shows the slow, standby sample rate on the left. As the tip of the key is inserted into the keyway and across the light beam, the amplitude of the optical pulses at the detector decrease and at a preset level the microprocessor automatically switches the master clock into the high sampling rate. The center portion of FIG. 8A shows sampling for a key with a small-large-small-large hole pattern at a uniform key insertion rate. As shown, many samples are taken as each hole passes through the beam and the peak sample value corresponds to the instant this hole is exactly centered in the infrared beam. FIG. 8B shows the case for a non-uniform insertion rate where the operator hesitated while the third hole was being read. FIG. 8C shows a very rapid insertion of the key. A significant feature of the system of the invention is that all three cases depicted in FIGS. 8A-8C will result in a valid code making the system independent of insertion rate of the key. This is achieved by programming the microprocessor to look for and record only the peak values associated with each hole. These peak values are noted by points A, B, C, and D in FIGS. 8A-8C.

An additional design feature makes the read process immune to various sources of electromagnetic interference. To accomplish this the microprocessor performs a running average of several adjacent samples rather than relying on a single sample to determine the peak value. When a valid key is fully inserted into the ignition lock the microprocessor will have recorded and stored four peak values, one for each key hole. When the ignition lock is rotated to the start position, the microprocessor calculates the arithmetic average of the highest peak value and the lowest peak value. Any hole value above this average value is then identified and stored as a large hole and any hole value below this is identified and stored as a small hole. There is one exception to these instructions. If the lowest peak value is above 85% of the highest peak value then all holes are identified as being the same size. This recognition algorithm is used to make the system independent of the absolute signal levels which may drift in time and with temperature changes. As previously described with regard to FIGS. 5A and 5B, a comparison is made between the code recorded during key insertion and the valid code stored in the nonvolatile memory. If the codes are the same, the starter and fuel outputs are enabled.

There are numerous other possibilities for designing key means for use with the system of the invention. For example, it is possible to use the first four cuts starting from the tip of a conventional key for the mechanical portion of the lock and the last two cuts for a key shape reader. It is desirable to continue to use a mechanical portion of the lock for automotive applications so that the steering wheel can not be rotated when the car is locked, as mandated by Federal Safety Regulations. By devoting the last two cuts in the key to a shape reader, the total number of shape combinations will be $5 \times 5 = 25$ for GM keys. By limiting the design to different adjacent cut levels in at least the last two cut positions, to simplify the detection electronics, the number of possible shapes is reduced to twenty.

Alternatively, it is possible to use a nonstandard key blank that is longer than the standard key blank to include eight cuts instead of the standard six. The first six cuts provide the same mechanical security as in present General Motors' locks, while the last two cuts are devoted to shape reading.

Still further key designs may include a series of unconventional cuts in a standard metal key blank that can be optically read; for example, a series of narrow, comb-like cuts of variable spacing on the opposite side of the key from the conventional cuts, or a series of holes of varying diameter in the lower shaft portion of the key.

The use of the security system of the invention for motor vehicles has advantages beyond heightened security. For example, the electrical switch associated with the ignition lock for warning the driver that the key is in the ignition when the driver's door is open has always been troublesome and relatively expensive for automobile manufacturers. The inclusion of a shape reader in the ignition lock can eliminate the electrical switch by having the light emitting diode and photodiode turn on whenever the driver's door is unlocked or by having these components continuously active as in the preferred embodiment of the invention previously described. In this manner, the shape reader can be used instead of the electrical switch to detect the insertion and removal of the key from the ignition.

Figure 7A:
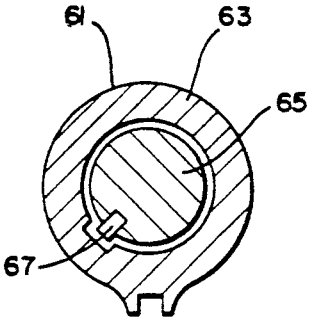
FIG. 7A is a cross sectional view of a typical ignition lock.
Figure 7B:
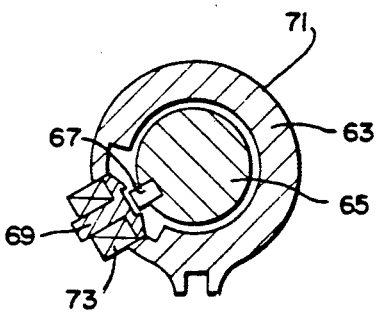
FIG. 7B shows a modified structure that can be electronically released or released by a conventional key.

FIG. 7A shows a cross section of a typical ignition lock 61 used by General Motors. The outer shell 63 is fixed in the steering column. The inner core 65 is prevented from rotation by the sidebar 67 unless a valid key is inserted in the lock. In this case, the sidebar moves towards the center of the core until its outer surface is flush with the core's surface. FIG. 7B is a modified ignition lock 71. This lock can also be released with a key. Alternatively, it can be released by electrically energizing the solenoid 73, which withdraws an element 69 normally retaining the sidebar 67.

Figure 7C:
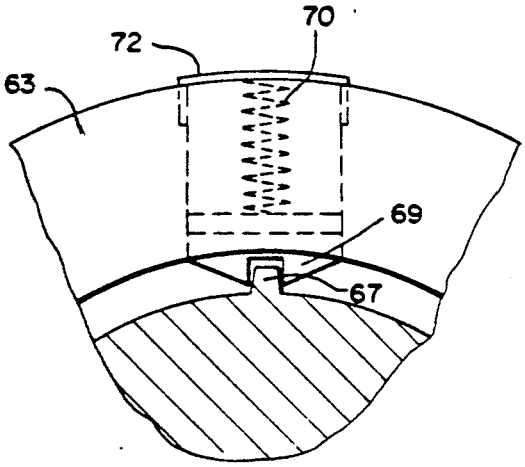
FIG. 7C is a cross sectional view of the sidebar release element for use in the modified structure of FIG. 7B.
Figure 7D:
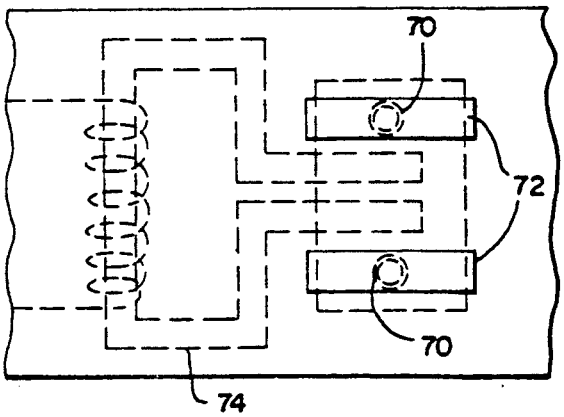
FIG. 7D is a top view of the sidebar release element connected to an electromagnet.

FIGS. 7C and 7D show an alternative way of retaining and releasing element 69 from sidebar 67 in the ignition lock. As shown in FIG. 7C, the sidebar release element 69 is spring loaded within shell 63 by springs 70 so that it is forced down to retain the sidebar 67. Spring keeper 72 is fixed inside the shell along its outer circumference to maintain the springs in position. FIG. 7D shows how an electromagnet 74 activated with a drive current is used to magnetically attract the sidebar release element, which is made of permalloy or other suitable magnetic material. When the drive current to the electromagnet is turned off, the springs force the sidebar release element down into the locked position.

A further advantage of the shape reader of the invention is that the light emitting diode can serve the dual function of illuminating the key hole and reading the shape of the key inserted therein. This advantage may be optimized by making the exposed portion of the ignition lock from a strong but transparent plastic material.

Several modifications of the key shape reader can be made to improve its performance. To avoid the possibility of stray ambient light interfering with the key shape reader, the light emitting diode should be modulated on and off at a relatively high frequency, up to 100 KHz, so that the well known advantages of timed AC detection can be used. In order to avoid inaccurate readings due to dirt accumulation in the optical path between the light emitting diode and the photodiode, the chamber can be filled with a durable transparent material such as lucite, glass or even sapphire for extreme scratch resistance. Once the chamber is filled, the tendency for dirt accumulation will be greatly reduced.

Finally, in order to prevent time delays imposed upon a valid operator who does not insert his key correctly or whose key has a blocked hole, the processor can be programmed so that unless it receives the requisite number of code signals, i.e., one for each hole or other shaped characteristic used, it will allow reinsertion and reading of the key without imposing a time delay. To advise the operator that the processor was unable to read the key, the processor can activate a warning light or message instructing the operator to remove and reinsert the key.

The optical key shape reader security system can also be combined with other desirable functions, particularly when installed in an automobile. For example, as previously mentioned, the system can be connected to the driver's door and the processor programmed to activate a chime or other warning device whenever the driver's door is opened with the key inserted in the ignition lock. Partially or fully withdrawing the key from the lock causes the processor to deactivate the chime.

While the security system of the invention is particularly adapted for use with motor vehicles, it has much wider applicability to any system employing a key lock. In addition, the system of the invention can be combined with other security systems to provide versatility. For example, the system can be used in conjunction with the optical system disclosed in U.S. Pat. Nos. 4,573,046 and 4,665,397, the disclosures of which are hereby incorporated by reference. In such systems, the processing means is programmed to analyze the photoelectrical signal generated by the optical key shape reader or a photoelectrical signal generated by an optical transmitting unit as described in the aforementioned patents. Either signal is sufficient to operate the ignition.

The optical key shape reader of this invention provides significant advantages over existing automobile security systems. There are no electrical contacts between the lock and key or other electrical components such as resistor pellets, that can wear, corrode, bend, or fall out, if the key is not inserted perfectly straight each time. Also, because the wires to the light emitting diode and photodetector are secured to the fixed shell of the ignition lock, rather than the rotating core, they are not subjected to cyclic fatigue each time the lock is turned on or off. The lock cylinder portion of the system of the invention is also advantageously less complex and, therefore, less costly than conventional ignition locks. This is due to the elimination of the various components normally used to activate the "key-in-the-ignition" wiring switch. Finally, the invention will be advantageous to auto dealers and locksmiths in reducing their key blank inventories. With the preferred mode of operation of the system of the invention only one key blank need be carried to service all ignition locks. The standard key blank will contain four small pilot holes. When the key is cut for a particular lock, the proper combination of holes will be made by enlarging the pilot holes with a simple hand tool to place the digital code on the key. There is no need for a separate series of holes in the key to provide a clock-track as in the prior digital key systems.

While the present invention has now been described in terms of certain preferred embodiments, one skilled in the art will readily appreciate that various modifications, changes, omissions and substitutions may be made without departing from the spirit thereof. It is intended, therefore, that the present invention be limited solely by the scope of the following claims.

I claim:

1. A security system comprising:

means for photoelectrically deriving an electrical signal from a shape characteristic of a key, said shape characteristic being the cuts of varying depths on one edge of the shaft of the key, a single linear series of holes of varying diameter in the shaft of the key, or a single linear series of slots of varying heights in the shaft of the key;

means remote from said photoelectrical means for comparing said electrical signal to one or more electrical signals stored in memory to determine whether they are the same; and means for enabling a function upon determining that said photoelectrically derived electrical signal is the same as said electrical signal stored in memory.

2. The security system of claim 1, further comprising means for disabling the security system for a predetermined time delay if the photoelectrically derived electrical signal is different from the electrical signal stored in memory.

3. The security system of claim 1 wherein said means for photoelectrically deriving an electrical signal from a shape characteristic of a key comprises light emitting means and light detecting means disposed in a fixed shell upon opposite sides of a passageway for receiving a key in a rotatable inner member disposed within said fixed shell of a lock mechanism.

4. The security system of claim 3, wherein said passageway is within an ignition lock for a motor vehicle.

5. The security system of claim 1, wherein said means remote from said photoelectrical means is located behind the dashboard of the motor vehicle.

6. The security system of claim 3, wherein said photoelectrical means generates an electrical signal based upon the intensity of light received by said light receiving means.

7. The security system of claim 6, wherein the intensity of light received by said light receiving means is varied by the shape of a key inserted into the key receiving chamber.

8. The security system of claim 7, wherein said key has four cuts for operating a mechanical lock and two cuts for varying the intensity of light receiving by said light receiving means.

9. The security system of claim 6, wherein the intensity of light received by said light receiving means is varied by the shape of slots in the upper shaft portion of a key inserted into the key receiving chamber.

10. The security system of claim 6, wherein the intensity of light received by said lighting receiving means is varied by the diameter of holes in the lower shaft portion of the key.

11. The security system of claim 3, wherein said light emitting means illuminates said passageway for receiving a key.

12. The security system of claim 3, wherein said light emitting means is a light emitting diode modulated at a frequency up to 100 KHz.

13. The security system of claim 1, wherein said memory is a nonvolatile memory.

14. The security system of claim 13, wherein the nonvolatile memory can be reset with a manual switch associated with said means remote from said photoelectrical means for comparing one or more electrical signals stored in memory.

15. The security system of claim 13, wherein said comparing means is enabled only after an ignition lock is turned to the start position.

16. The security system of claim 1, wherein the first photoelectrically derived electrical signal is stored in a nonvolatile memory unit in said means remote from said photoelectrical means and all subsequent signals are compared to this first signal to determine if they are the same.

17. A security system comprising:

means for receiving key means;

means for photoelectrically deriving a coded electrical signal from a single series of apertures of varying dimensions aligned in an axially extending row on the key means when the key means is inserted into said receiving means;

means remote from said photoelectrical means for comparing said coded electrical signal to one or more coded electrical signals stored in memory to determine whether they are the same; and means for enabling a function upon determination that said photoelectrically derived coded electric signal is the same as said coded electrical signal stored in memory.

18. The security system of claim 17, wherein said means for photoelectrically deriving said coded electrical signal comprises:

means for generating and transmitting optical signals and means for receiving and converting said optical signals into electrical signals in said receiving means;

means for sampling the electrical signals generated in said receiving means;

means for determining from said sampled electrical signals peak values corresponding to the dimension of each of the apertures in the key means; and means for generating the coded electrical signal from said peak value.

19. The security system of claim 18, wherein said receiving means comprises a rotatable member having a passageway for receiving said key means.

20. The security system of claim 19, wherein said rotatable member is disposed within an outer shell and said means for generating and transmitting optical signals and for receiving and converting said optical signals into electrical signals are disposed within said shell on opposite sides of said passageway.

21. The security system of claim 20, wherein said passageway is within an ignition lock for a motor vehicle.

22. The security system of claim 18, wherein said single series of apertures in said key means comprises a row of four holes having one of two predetermined diameters.

23. The security system of claim 18, further comprising means for disabling the security system for a predetermined time delay if the photoelectrically derived coded electrical signal is different from the electrical signal stored in memory.

24. The security system of claim 18, wherein said means for sampling samples said electrical signals at two different sample rates.

25. The security system of claim 24, wherein said means for sampling samples said electrical signals at a rate between about 50 and 200 samples per second and at a rate between about 1,500 and 2,000 samples per second.

26. The security system of claim 25, wherein said sampling means samples said electrical signals at the rate between about 50 and 200 samples per second when there is no key means in said memory means.

27. The security system of claim 25, wherein said sampling means samples said electrical signals at the rate of between about 1,500 to 2,000 samples per second when there is key means in said receiving means.

28. The security system of claim 18, further comprising means for indicating when the number of peak values determined does not correspond to the number of apertures in the key means.

29. The security system of claim 17, wherein said function is the starter of an automobile.

30. The security system of claim 17, wherein said function is a warning indicating that the key means is in the receiving means.

31. The security system of claim 17, further comprising means for removing the coded electrical signal stored in memory.

32. The security system of claim 23, further comprising means for reducing said time delay.

33. The security system of claim 18, further comprising means for switching electrical power to individual components of the system.

* * * * *